United States Patent [19]

Struble

[11] 4,214,694

[45] Jul. 29, 1980

[54] BOX COVER, BLANK THEREFOR

[75] Inventor: Glenn E. Struble, Oxford, Ohio

[73] Assignee: Diamond International Corporation, New York, N.Y.

[21] Appl. No.: 954,687

[22] Filed: Oct. 25, 1978

[51] Int. Cl.[2] ..... B65D 5/22; B65D 5/24

[52] U.S. Cl. ..... 229/31 FS; 229/34 R

[58] Field of Search ..... 229/31 FS, 34 R

[56] References Cited

U.S. PATENT DOCUMENTS

| | | | |
|---|---|---|---|
| Re. 24,946 | 3/1961 | Burden | 229/34 R |
| 931,373 | 8/1909 | Bachmann | 229/31 FS |
| 1,083,048 | 12/1913 | Bachmann | 229/31 FS |
| 1,778,462 | 10/1930 | Nourse et al. | 229/31 FS X |
| 2,036,542 | 4/1936 | Rosenthal | 229/31 FS X |
| 2,702,663 | 2/1955 | Klein | 229/31 FS |
| 2,768,776 | 10/1956 | Weiss | 229/31 FS |
| 2,846,929 | 8/1958 | Hickin | 93/51 M X |
| 3,062,429 | 11/1962 | Liman et al. | 229/34 R |
| 3,152,748 | 10/1964 | Desmond et al. | 229/34 R |
| 3,887,126 | 6/1975 | Wilson | 229/34 R |

FOREIGN PATENT DOCUMENTS

| | | | |
|---|---|---|---|
| 2302253 | 9/1976 | France | 229/31 FS |

*Primary Examiner*—Davis T. Moorhead
*Attorney, Agent, or Firm*—Karl W. Flocks

[57] ABSTRACT

Box cover comprising a top panel, fold over sides and fold over ends, the fold over sides each including a corner assembly tab and a floating corner reinforcement tab at opposite ends thereof, each assembly tab including structure allowing the reinforcement tab adjacent thereto and associated therewith to be nestled thereagainst and to extend generally coplanar with a substantial portion of the assembly tab. The method of assembling the box cover from an integral blank with glue applied to the inside of the fold over ends, utilizing a straight or planar surface mandrel moved into position indirectly engaging a pair of floating reinforcement tabs and a pair of assembly tabs in substantially a single plane and directly engaging a fold over end.

13 Claims, 17 Drawing Figures

BOX COVER, BLANK THEREFOR

BACKGROUND OF THE INVENTION

1. Field of the Invention

Prior to the instant invention it has been customary for box manufacturers to ship to their customers box blanks including blanks for box covers which the customer assembled on the customer's assembly machine. These assembly machines included mandrels, folding mechanisms, and glue applicators. A common mandrel is one which has straight sides and for special box covers, a special mandrel was utilized with cut-out portions to accommodate several thicknesses of tabs at the corner of a box cover for reinforcing same. When reinforcement tabs were not used, the straight mandrel operated satisfactorily but when floating corner reinforcement tabs as well as corner assembly tabs formed part of the box top blank, a special mandrel with offset or cut-out formations at the edges of the mandrel was required to obtain optimum results. In practice, the customer neglected to change from one mandrel to another with the result that the assembled box cover became unglued at the center and with neither the construction nor the appearance then being acceptable.

2. Summary of the Invention

This invention relates to box covers such as, for example, shoe box covers and, more particularly, to the cover construction, the blank from which it is made and the method of assembly.

OBJECTS OF THE INVENTION

It is an object of the invention to make it unnecessary for the customer to utilize any special mandrels so that the customer may proceed to use a straight sided mandrel even when the carton blank includes, for each corner of a shoe box cover, a floating corner reinforcement tab and a corner assembly tab.

It is another object of the invention to provide a new box cover construction and a blank therefor and the method of assembly.

Other objects and the nature and advantages of the instant invention will be apparent from the following description taken in conjunction with the accompanying drawings.

BRIEF DESCRIPTION OF THE DRAWINGS

The present invention will be readily and clearly understood by the reader upon reviewing the accompanying drawings in which.

DETAILED DESCRIPTION OF THE INVENTION

Figure 1:
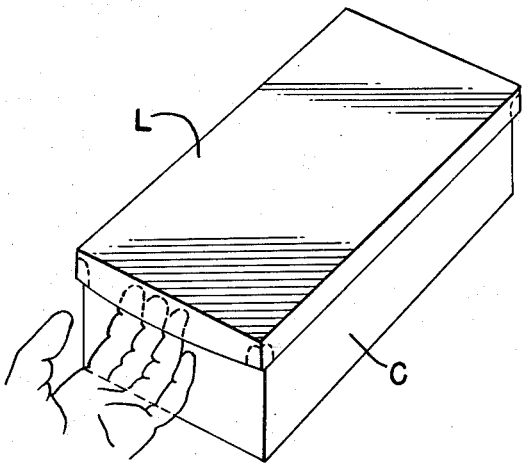
FIG. 1. (PRIOR ART)
FIG. 1 shows a view in perspective of a box cover or like member of the type disclosed herein in use over a box.

Referring now in detail to the drawings, the reader will readily appreciate from FIG. 1 that the subject matter of the invention disclosed herein may take the form of a box cover L of pasteboard material or the like and which may be used to close a shoe box C, for example. It is to be understood, however, that the present invention may also be used as a receptacle, tray, carton, or the like. The present invention is not to be limited in use as a box cover, but instead, may be put to any use as may be appropriate from considerations given to its structural characteristics.

Figure 2:
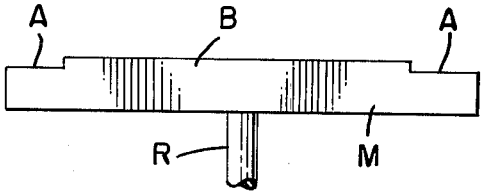
FIG. 2 (PRIOR ART)
FIG. 2 is a side elevational view of a common mandrel with a planar working face which is well known in the prior art.
Figure 2A:
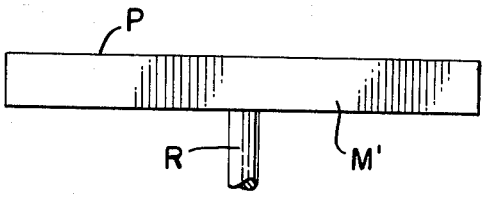
FIG. 2A is a side elevational view of a special mandrel with cut-out portions also known in the prior art and used to accommodate multiple thicknesses in wall members to be assembled.

FIGS. 2 and 2A show two forms of mandrels used in the assembly of box covers of the general type of which the cover disclosed herein constitutes an improvement. In the past, when box covers were made with corner reinforcement tabs, it was found desirable and necessary to use a mandrel M of the type in FIG. 2 comprising offset or cut-out formations A,A at opposite edges of an intermediate principal surface B on the forward end of rod R. The mandrel M' with a conventional plane working surface P ahead of the leading end of rod R illustrated in FIG. 2A, except for neglect or mistake, has been limited to use in the assembly of covers without corner reinforcement tabs where accommodation of such extra thicknesses of material by cut-off formations are not required. The present invention will be seen to reside in a new and improved box cover with corner formation including reinforcement tabs which may be optimumly assembled by using the conventional mandrel M' with the flat planar working surface P without cut-out formations.

Figure 3:
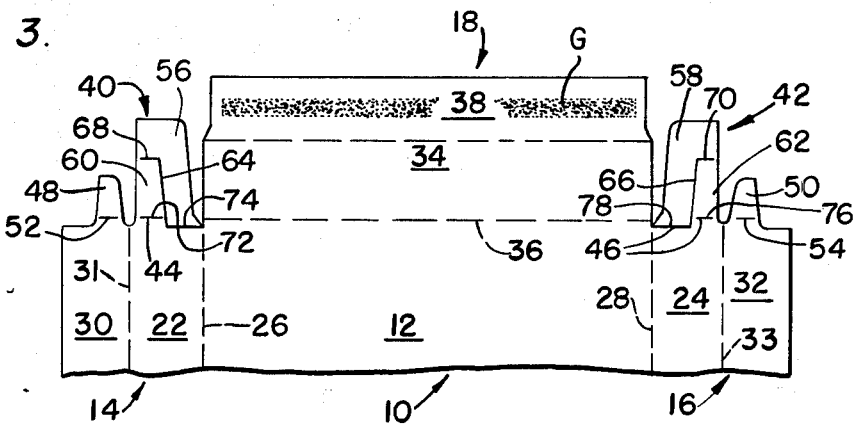
FIG. 3 is a fragmentary plan view of a blank for forming a box cover according to the present invention.
Figure 4:
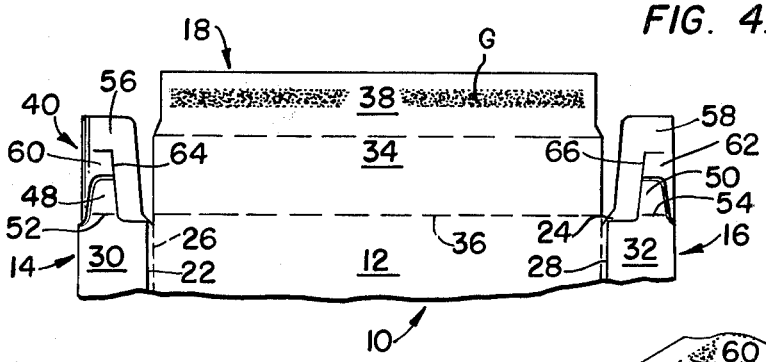
FIG. 4 is a fragmentary plan view of the blank of FIG. 3 after an initial operation has been carried out to form a box cover.
Figure 5:
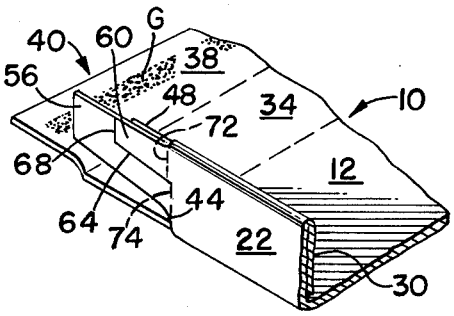
FIG. 5 is a fragmentary view in perspective showing the left corner of the blank of FIGS. 3 and 4 after a second operation has been carried out to form the box cover.

With reference now to FIGS. 1 and 3–10, it is to be understood that the inventive concept of the invention disclosed herein resides in a box cover L or like member illustrated generally in FIG. 1 as being in normal usage over a shoe box C or the like, and the blank 10, which is shown with the underside or inside of the cover to be erected therefrom in view during various stages of assembly and erection in FIGS. 3–10. It is also to be understood that although only one end of blank 10 is illustrated in FIG. 3 and only one corner of the partially assembled cover is illustrated in FIG. 5 for purposes of convenience, the blank and cover to be produced therewith is symmetrical with the fragmentary portions whether as illustrated in FIGS. 3 and 5 or as in FIGS. 4 and 6–10. With the foregoing in mind, it will be appreciated that the blank 10 for forming cover L is of pasteboard or like material and comprises a generally rectangular top panel 12, fold over side walls 14, 16 extending along opposite sides 26, 28, respectively, and fold over end walls 18 of which only one is illustrated along end 36 of top panel 12. Each side wall 14 comprises an outer side wall panel 22, 24 integral with and hingedly associated with top panel 12 along opposite sides 26, 28, respectively, and inner side wall panels 30, 32 integral with and extending alongside a respective one of the outer side wall panels 22, 24 at fold lines 31, 33. Each end wall 18 comprises an outer end wall panel 34 integral with and hingedly associated with top panel 12 along an opposite end 36 and an inner end wall panel 38 integral with and extending alongside an outer end wallpanel 34. For purposes of assembling the blank 10 to form a cover L, means are provided at each corner in the form of corner assembly tabs 40, 42, which, as clearly illustrated in FIG. 3, are integral with and extend from the ends of side wall panels 22, 24 along duplex hinge members 44, 46, respectively. Duplex hinge member 44 is seen to comprise a first hinge portion 72 in the form of a score line and a second hinge portion 74 offset from first hinge portion 72. Duplex hinge member 46, like its symmetrical counterpart, also comprises a first hinge portion 76 in the form of a score line and a second hinge portion 78 offset from first hinge portion 76.

As is known in the prior art, each outer side wall panel 30, 32 is provided with a floating corner reinforcement tab 48, 50 at the respective ends thereof adjacent to corner assembly tabs 40, 42. Floating corner reinforcement tabs 48, 50 extend from the respective ends of inner side wall panels 30, 32 along hinges 52, 54 along which they are foldable.

Each corner assembly tab 40, 42 includes a principal portion 56, 58 and a displaceable portion 60, 62, respectively. Each displaceable portion 60, 62 is defined by first hinge portion 72, 76, a slit 64, 66, and a core line 68, 70, in the corner assembly tab 40, 42, respectively. Score lines 68, 70 are spaced-apart from hinge portions 72, 76. Principal portions 56, 58, on the other hand, are on opposite sides from displaceable portions 60, 62 along slits 64, 66 and score lines 68, 70 on corner reinforcing tabs 40, 42 and further extend from second hinge portions 74, 78, respectively.

Attention is directed at this time to the offset relationship between first and second hinge portions 72, 74 of hinge member 44 and the similar relationship between first and second hinge portions 76, 78 of hinge member 46, namely, that each of the first hinge portions 72, 76 are situated at a distance farther from the longitudinal midpoint of outer side wall panels 22, 24 compared to the location of second hinge portions 74, 78 which are situated closer to the longitudinal midpoint of the outer side wall panels 22, 24. The difference in the distance between first and second hinge portions 72, 76 and 74, 78 from the longitudinal midpoints of the respective outer side wall panels 22, 24 is on the order of about the thickness of the blank 10.

Figure 6:
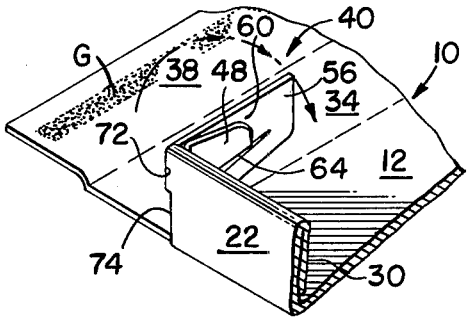
FIG. 6 is a fragmentary view in perspective of the blank similar to FIG. 5 after a third operation has been carried out to form the box cover.
Figure 14:
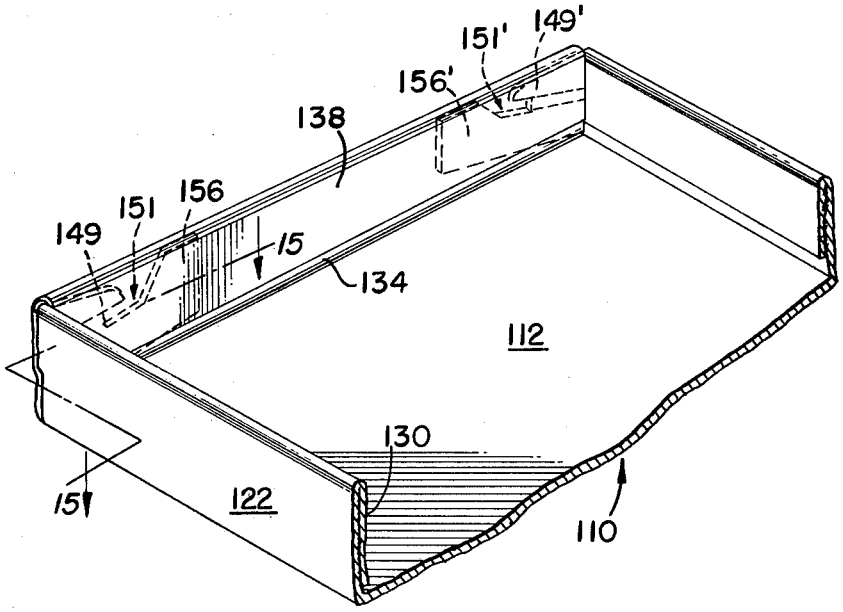
FIG. 14 is a fragmentary view in perspective of the end of the box cover in FIG. 13 after a further operation has been carried out to bring it into the same stage of completion as in the case of FIG. 10.
Figure 15:
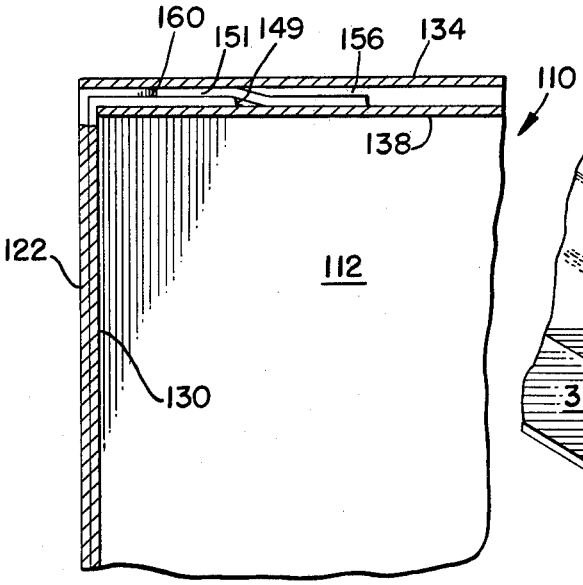
FIG. 15 is a fragmentary view in elevation of the box cover of FIG. 14 taken along the plane of 15—15.

Before actually taking any steps to effect formation of cover L from blank 10, the reader should take note that corner assembly tabs 40, 42 are rotated toward the reader from the position shown approximately 90° along hinge members 44, 46 and floating corner reinforcement tabs 48, 50 are rotated away from the reader from the position shown approximately 90° along hinges 52, 54 to the assembled condition of the cover L. The initial steps toward assembling a cover L from blank 10 comprises folding inner side wall panels 30, 32 one hundred-eighty-degrees (180°) along fold lines 31, 33 against outer side wall panels 22, 24, respectively, as shown in FIG. 5. In the folded over condition of inner side wall panels 30, 32 floating corner reinforcement tabs 48, 50 will be disposed in lapping relationship with displaceable portions 60, 62 in such a way that the slits 64, 66 define the lateral expanse of floating corner reinforcement tabs 48, 50, that is, tabs 48, 50 do not cross over slits 64, 66 from displaceable portions 60, 62 to overlap principal portions 56, 58. Moving from FIG. 4 to FIG. 5, the reader can see that side wall 14 is turned up approximately 90° along side 26 of top panel 12 as side wall 16 is also to be understood to be turned up in similar fashion. FIG. 6 shows corner assembly tab 40 rotated clockwise in the direction of the arcuate arrows along first and second hinge portions 72, 74 with floating corner reinforcement tab 48 being constrained by displaceable portion 60 to rotate about hinge 52. It can now be understood from FIG. 6 that floating corner reinforcement tab 48 and corner assembly tab 40 are rotated to positions in opposite directions from their positions mentioned above in connection with FIG. 3 since floating corner reinforcement tab 48 is placed in reverse condition as shown in FIG. 4 before being rotated along hinge 52. Attention is now directed to hinge 52 which is shown in FIG. 3 as being approximately in line with first hinge portion 72, and with this in mind it will be readily understood that the reader is looking at the upper or outer surface of floating corner reinforcement tab 48 and the under or inner side of corner assembly tab 40 as related to FIGS. 4–6 from FIG. 3. In spite of the pre-formed hinge 52 floating corner reinforcement tab 48 will exhibit some inherent resistance to being folded, this resistance coupled with the location of hinge 52, the slit 64 and score line 68 formed in corner assembly tab 40, and the off-set relationship of second hinge portion 74 at a location closer to the longitudinal midpoint of outer side wall panel 22 will effect a condition in which floating corner reinforcement tab 48 will be nestled against displaceable portion 60 to displace the latter outwardly as is apparent in FIG. 6 and from the opposite side of the blank in FIGS. 7 and 7A wherein the thickness of principal portion 56 can be observed beneath floating corner reinforcement tab 48 at slit 64 and so that floating corner reinforcement tab 48 will be at least partially coplanar with principal portion 56. The foregoing characteristics described herein-above with respect to floating corner reinforcement tab 48 and corner assembly tab 40 are to be understood as being also applicable to floating corner reinforcement tab 50 and corner assembly tab 42 and like tabs at opposite ends of the fragmentary blank 10 illustrated in FIG. 1.

With the foregoing construction in mind it can readily be appreciated that without the feature of the displaceable portions 60, 62 at opposite sides of the cover, and with added thickness of material from floating corner reinforcement tabs 48, 50, a mandrel M with cut-out portions A was required to effect adequate distribution of pressure in gluing operations to produce an assembled cover L. With the formation of displaceable portions 60, 62 whereby floating corner reinforcement tabs 48, 50 can substantially merge into the plane of the corner assembly tabs 40, 42, the thickness of such floating corner reinforcement tabs 48, 50 is largely avoided so that a mandrel M' with a planar working surface P may be used in gluing operations to produce covers or like members with floating corner reinforcement tabs 48, 50.

Figure 7:
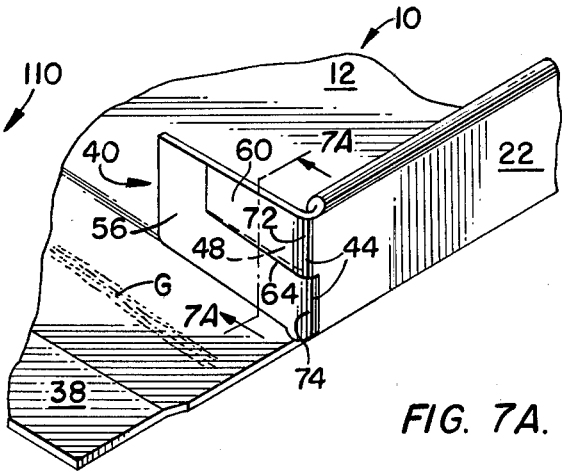
FIG. 7 is a fragmentary view in perspective of the blank at the same stage of formation represented in FIG. 6, but rotated 90° in the counterclockwise direction.
Figure 7A:
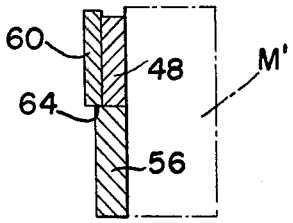
FIG. 7A is a sectional view taken along the plane 7A—7A in FIG. 7 and drawn on an enlarged scale.

Upon closer examination of FIG. 7A the reader will observe that displaceable portion 60 and principal portion 56 which are actually parts of one and the same member, namely, corner assembly tab 40 are separated only by slit 64, that floating corner reinforcement tab 48 lies pretty much in the same plane as principal portion 56, and that displaceable portion 60 is displaced at least partially from the plane of principal portion 56, these relationships being inherent from the structure from the various parts to facilitate use of a plane surface mandrel M' in gluing operations. It is also to be noted that while floating corner reinforcement tab 40, principal portion 56, and displaceable portion 60 are illustrated at various thicknesses, in actuality these parts are of one and the same thickness and, for example, is on the order of about 1/32 of an inch.

Figure 8:
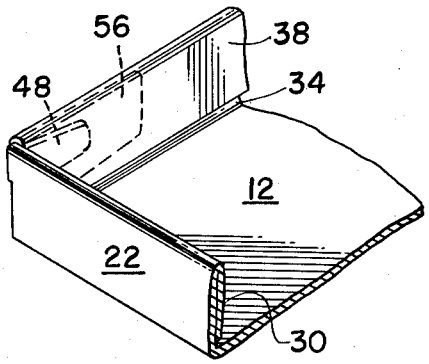
FIG. 8 is a fragmentary view in perspective of the box cover similar to that represented in FIG. 6, but after a fourth operation has been carried out to form the box cover.

By reason of the displaceable portions 60, 62 which compensate for the added thickness of material of floating corner reinforcement tabs 48, 50 by allowing such added thickness to be substantially absorbed by and/or merged into corner assembly tab 40 in the area vacated by displaceable portion 60 as illustrated in FIGS. 6 and 7A. With floating corner reinforcement tabs 48, 50 thus merged into corner assembly tabs 40, 42, pressure applied thereto from a mandrel M' with planar surface P will be more evenly distributed thereagainst to effect bonding by glue G between inner end wall panel 38 and outer end wall panel 34 as seen in FIG. 10. Pressure from mandrel M' will be applied to inner end wall panel 38 when the surface P' is moved from the position shown in FIG. 9 to that in FIG. 10 with pressure applied in the direction of the arrows against inner wall panel 38 folded inwardly as shown in FIG. 8. A good bond will then be obtainable between inner end wall panel 38 and corner reinforcement tabs 48, 50 and between principal portions 56, 58 of the corner assembly tabs 40, 42 from glue G applied to inner end wall panel 38. Also, a bond may be obtained between outer end wall panel 34 and corner assembly tabs 40, 42 by applying glue to outer end wall panel 34, if desired.

Figure 9:
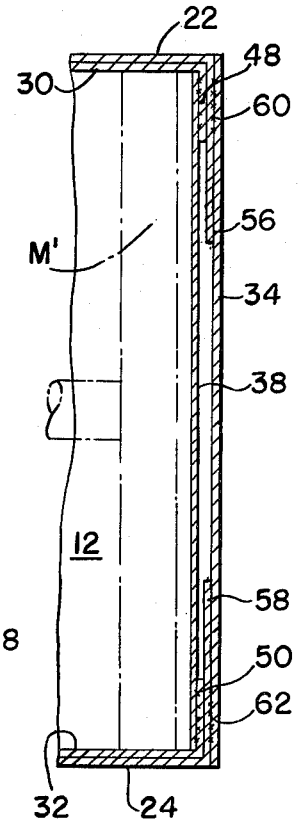
FIG. 9 is a fragmentary plan view in section through the end of the box cover according to the present invention at the stage of assembly represented in FIG. 8.
Figure 10:
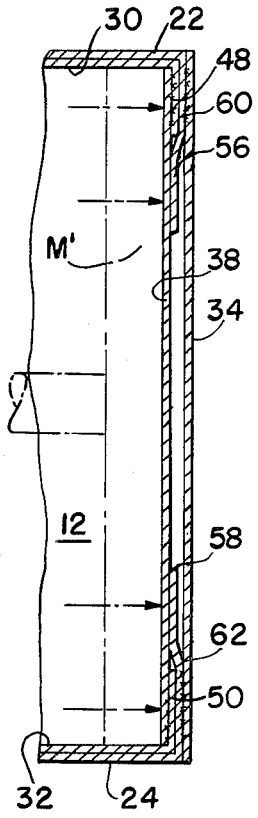
FIG. 10 is a fragmentary plan view in section of the box cover similar to FIG. 9 with pressure applied to end wall panels and assembly tabs from within the cover to effect assembly of the cover.
Figure 11:
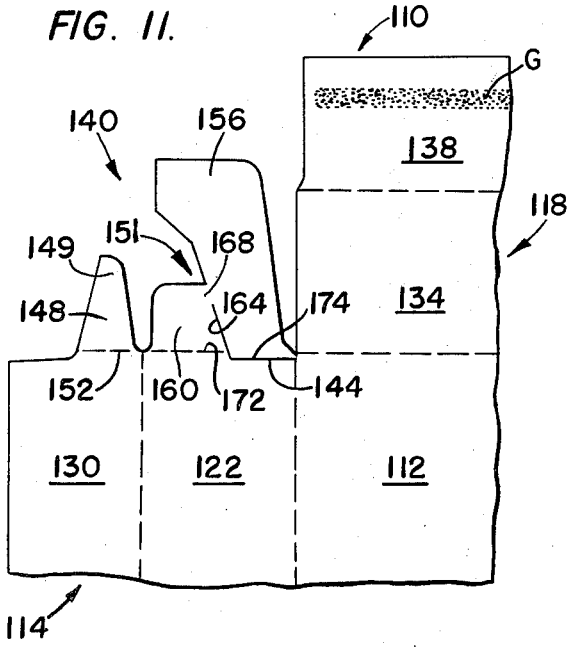
FIG. 11 is a fragmentary plan view of one corner of an alternative form of a blank for making the box cover according to the present invention.

Although a substantial space appears between inner and outer end wall panels 38, 34 as illustrated in FIGS. 9 and 10, it is noted that sectional views of cover L has been drawn at greater than actual thickness to provide a better understanding of the deformation and/or displacement of the various parts concerned in the course of the assembly process of cover L. In actual practice cover L may be from about a half to as little as only about a third in thickness of that which is illustrated in FIGS. 9 and 10. With the foregoing in mind, it is to be understood that a coat of glue G of ordinary thickness will be effective in bonding inner end wall panel 38 and outer end wall panel 34 at the center portions thereof between corner assembly tabs 40, 42.

When the inner end wall panel 38 is folded over outer end wall panel 34 it adheres in a manner satisfactory to the customer to provide a strong shoe box cover L with the corner reinforcement tabs 40, 42 and floating corner reinforcement tabs 48, 50 in position to reinforce the corner construction. The straight and non-special mandrel M' is able to operate satisfactorily to cooperate with the assembly mechanism so that end wall panels 34 and 38 are properly glued and the several thicknesses of box cover stock at the reinforced corners are bulged outwardly slightly in a novel manner. This resultant corner construction is strong and makes it unnecessary for the customer to switch mandrels when proceeding from assembly of a simpler type box cover to box covers made from blanks as herein described.

An alternative embodiment of the disclosed invention is provided in FIGS. 11–15 wherein a blank 110 generally similar to blank 10 illustrated in FIGS. 3–10, but including a different form of corner assembly tab 140, 140'. Blank 110, like blank 10, includes a generally rectangular top panel 112, with fold over side and end walls 114 and 118, respectively. Each side wall 114 comprises an outer side wall panel 122 and inner side wall panel 130 and each end wall 118 comprises an inner end wall panel 138 with glue G thereon and an outer end wall panel 134, which may have glue thereon, if desired. At opposite ends of each outer side wall panel 122 extends a corner assembly tab 140 and similarly at opposite ends of each inner side wall panel 130 extends a floating corner reinforcement tab 148. Each corner assembly tab 140 is formed with a cut-out or notch 151 the function of which will become apparent hereinbelow. Each floating corner reinforcement tab 148 includes a tip 149 which may readily be displaced laterally into the cut-out or notch 151 from pressure applied, for example by a mandrel M'. Each corner assembly tab 140 also comprises a duplex hinge member 144 with first and second hinge portions 172, 174, respectively arranged at comparable distances from the longitudinal midpoint of outer side wall panel 122 as corresponding portions are arranged in blank 10. Each floating corner reinforcement tab 148 is foldable along a hinge 152 located in the manner that hinge 52 is located in blank 10. Each corner assembly tab 140 also includes a principal portion 156 hinged to outer side wall panel 122 by second hinge portion 144. A slit 164 extends from first and second hinge portions 172, 174 between a displaceable portion 160 and principal portion 156 toward cut-out 151 but terminates short of cut-out 151 at a web 168 between displaceable portion 160 and principal portion 156.

Figure 12:
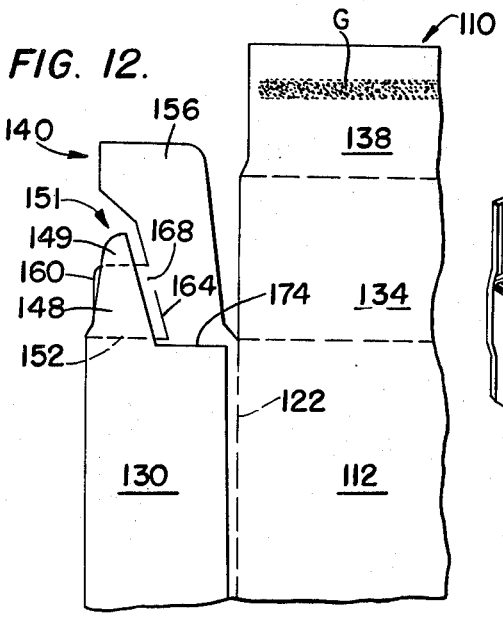
FIG. 12 is a fragmentary plan view of the blank of FIG. 11 after an initial operation has been carried out to form a box cover.
Figure 13:
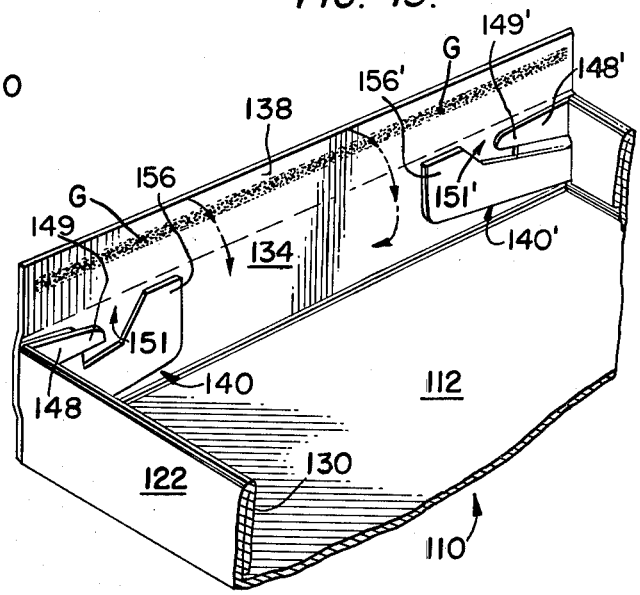
FIG. 13 is a fragmentary view in perspective of one end of the blank of FIGS. 11 and 12 after several additional operations have been carried out in forming a box cover.

When inner side wall panel 130 is folded over 180° on outer side wall panel 122 as illustrated in FIG. 12, floating corner reinforcement tab 148 overlies displaceable portion 160 without crossing slit 164 over on principal portion 156, but with displaceable tip 149 extending over cut-out 151. With the bank 110 in the stage of assembly illustrated in FIGS. 13–15, it will be readily appreciated that tips 149, 149' will have a tendency to be displaced into the area of cut-outs 151, 151' as a result of any outward pressure from a mandrel M' with a planar working surface P. It will also be understood that the part of floating corner reinforcing tabs 148 lying against displaceable portion 160 of corner assembly tab 140 will have a tendency to displace portion 160 if mandrel M' is applied thereagainst, because of flexibility provided the latter by slit 164 and the offset arrangements of hinge portions 172, 174.

From the above description it will be clear that a cover formed from blank 110 will include floating corner reinforcement tabs 148, 148' which will tend to merge into corner assembly tabs 140, 140' by reason of the presence of displaceable portions 160 or the like and notches 151, 151' in tabs 140, 140' and tips 149, 149' which will readily move into notches 151, 151', respectively, when urged by pressure from mandrel M' with planar surface P.

It will be obvious to those skilled in the art that various changes may be made without departing from the scope of the invention and the invention is not to be considered limited to what is shown in the drawings and described in the specification.

What is claimed is:

1. A box cover or like member of pasteboard or like material comprising a generally rectangular top panel, fold over side walls at opposite sides thereof, and fold over end walls at each end thereof, each of said side and end walls having an outer panel integral with and hingedly associated with said top panel and an inner panel integral with and extending along side a respective one of said outer panels, each of said outer side wall panels having a corner assembly tab at opposite ends thereof, each of said inner side wall panels having a floating corner reinforcement tab at opposite ends thereof, each of said corner assembly tabs including means allowing the floating corner reinforcement tab adjacent thereto and associated therewith to be nestled thereagainst and to extend generally coplanar with a substantial portion thereof.

2. A box cover or like member as defined in claim 1 wherein said means comprises a cut-out or notch portion removed from each of said corner assembly tabs whereby the said adjacent floating reinforcement tab may extend in place of the cut-out or notch portion.

3. A box cover or like member as defined in claim 1 wherein said means comprises a displaceable portion formed in each of said corner assembly tabs whereby the said adjacent floating reinforcement tab may extend in place of the displaceable portion.

4. A box cover or like member as defined in claim 3 wherein each of said displaceable portions is delineated by a pair of spaced-apart score lines at opposite ends thereof, a cut line along one side, and a free edge opposite from the cut line.

5. A box cover or like member as defined in any one of said claims 1–4 wherein said means allowing the floating corner reinforcement tab to extend generally coplanar with a substantial portion of the assembly tab comprises a duplex hinge member hingedly connecting each of said assembly tabs with one of said outer side wall panels with said duplex hinge portions including a first portion being situated farther from the longitudinal midpoint of the said outer side wall panel, a second portion being situated closer to the longitudinal midpoint of the said outer side wall panel, and each of said floating corner reinforcement tabs is integral with one of said inner side wall panels along a hinge foldable along side and within one of said second portions of a duplex hinge member.

6. A box cover or like member as defined in claim 5 wherein the hinge of each of said floating corner reinforcement tabs is spaced from the longitudinal midpoint of the said inner side wall panel substantially as far as one said first portion of an adjacent one of said duplex hinge members is spaced from the longitudinal midpoint of the respective outer side wall panel, each of said floating corner reinforcement tabs and the corner assembly tab adjacent thereto in the assembled and erected condition of said box cover being folded inwardly at about 90° with at least a part of each of said floating corner reinforcement tabs extending generally coplanar with a substantial portion of the corner assembly tab adjacent thereto.

7. A box or like member as defined in claim 6 wherein each of said first portions of said hinge members is coextensive with one of the said score lines delineating the displaceable portion of one of said floating corner reinforcement tabs.

8. A blank of pasteboard material or the like for forming a box cover or the like with a generally rectangular top panel, fold over side walls and fold over end walls, said fold over side walls each including an outer wall panel integral with the top panel and hinged thereto along one side thereof and further having an inner side wall panel foldable inwardly against the respective outer side wall panel, each of said outer side wall panels having corner assembly tabs at opposite ends thereof, each of said inner side wall panels having floating corner reinforcement tabs at opposite ends thereof, each of said floating reinforcement tabs comprising means allowing the corner reinforcement tab adjacent thereto to be nestled thereagainst and to extend generally coplanar with a substantial portion thereof.

9. The blank as defined in claim 8 wherein each of said floating corner reinforcement tabs comprises means whereby the floating corner reinforcement tabs will inherently tend to extend at least generally coplanar with a substantial portion of the corner assembly tab adjacent thereto when the two are folded against each other at about 90° in the assembled and erected condition of the cover to be made with said blank.

10. The blank as defined in claim 9 wherein said means of each of said corner assembly tabs is in the form of a duplex hinge member along which such assembly tabs extend from said outer side wall panels, said duplex hinge member including a first portion situated closer to the longitudinal midpoint of the outer side wall panel and a second portion situated farther from the longitudinal midpoint of the outer side wall panel than the said first portion of the duplex hinge member is.

11. The blank as defined in claim 10 wherein each of said floating corner reinforcement tabs is spaced from the longitudinal midpoint of the inner side wall panel from which they extend substantially as far as the second portion of the duplex hinge member adjacent thereto is from the longitudinal midpoint of its outer side wall panel.

12. The blank as defined in claim 11 wherein said corner assembly tabs each include a slit extending from said duplex hinge member between the first and second portions thereof for at least the length of the floating corner reinforcement tab adjacent thereto.

13. The blank as defined in claim 12, said corner assembly tabs each include a notch or cut-out portion and said floating corner reinforcement tabs each extend at least partially alongside and into one of said notch or cut-out portions so as to be generally coplanar with the corner assembly tab adjacent thereto in the erected cover assembled from said blank.

* * * * *